United States Patent [19]

Carli

[11] 4,307,271

[45] Dec. 22, 1981

[54] SWITCH MECHANISM

[75] Inventor: Alvin J. Carli, Sebring, Ohio

[73] Assignee: The Alliance Manufacturing Company, Inc., Alliance, Ohio

[21] Appl. No.: 154,509

[22] Filed: May 29, 1980

[51] Int. Cl.[3] ..... H01H 3/16

[52] U.S. Cl. ..... 200/47

[58] Field of Search ..... 200/47, 153 T, 335, 200/332

[56] References Cited

U.S. PATENT DOCUMENTS

| | | | |
|---|---|---|---|
| 2,284,404 | 5/1942 | Martin | 200/47 |
| 3,439,134 | 4/1969 | Carli | 200/47 |
| 3,478,469 | 11/1969 | Estes | 200/47 |
| 3,619,532 | 11/1971 | Lyvang | 200/47 |
| 3,851,125 | 11/1974 | Deming et al. | 200/47 |

*Primary Examiner*—Willis Little

*Attorney, Agent, or Firm*—Pearne, Gordon, Sessions, McCoy & Granger

[57] ABSTRACT

A limit switch mechanism is disclosed which may be easily moved along a guide channel and actuated by a carriage movable along the guide channel. The limit switch is constructed of only three or four parts for simple and economical manufacture and assembly. The base of the switch is of resilient insulating material to permit the switch base to be snapped onto the guide channel to be resiliently secured in an adjustable position. A bent wire has actuator, actuating, pivot, and retention portions, with the actuating portion actuating the two contacts between closed and open condition. The retention portion retains the bent wire longitudinally of the pivot axis and acts on the guide channel rather than on the base to permit ready assembly of the bent wire onto the base.

23 Claims, 9 Drawing Figures

SWITCH MECHANISM

The foregoing abstract is merely a resume of one general application, is not a complete discussion of all principles of operation or applications, and is not to be construed as a limitation on the scope of the claimed subject matter.

BACKGROUND OF THE INVENTION

The switch mechanism of the present invention may be used and is intended for actuation by a powered carriage movable along an elongated guide channel. One example of this is a closure operator or garage door operator wherein a motor-powered carriage is movable along a horizontal guide channel and is connected to open and close an overhead-type or upward opening door. Such switch mechanisms may be used as limit switches to turn off the electric motor in the garage door operator at the up limit and closed limit of the door.

One example of such a limit switch is shown in U.S. Pat. No. 3,439,134, issued Mar. 28, 1966. This switch was suitable for use in a garage door operator, but incorporated a total of 13 parts, which was expensive in production of the individual parts and also expensive in the assembly of such parts in order to obtain proper operation thereof.

Such limit switches have been known and used for many purposes in the art and, as an example, may be used in an automatic garage door wherein it is desired to electrically deactuate an electric motor when the door has arrived at either an open or closed position. Because of the inertia of the door and mechanism which engages and actuates the switch, it is often necessary to make provision for overtravel without damage to the switch, i.e., the contacts or any other actuated part of the switch. Many devices of this type have been relatively complicated in construction and operation and, as a result, have been relatively expensive to manufacture.

SUMMARY OF THE INVENTION

The problem to be solved, therefore, is how to construct a switch which may be used as a limit switch and which is capable of simple and economical manufacture and assembly. This problem has been solved by a switch for actuation by a powered carriage movable along a guide channel, said switch comprising, in combination, a base, means for attaching said base to the guide channel, a contact part and a cooperable contact portion at least one of which is mounted on said base, means relatively insulating said contact part and said contact portiion, a bent wire having actuator, actuating and pivot portions, a journal on said base journaling said pivot portion on a pivot axis, said actuator portion adapted to be actuated by traverse of the carriage along the guide channel, said actuating portion being connected to said actuator portion to be moved with actuated movement of said actuator portion to relatively actuate said contact part and said contact portion between switch-open and switch-closed conditions, and retention means acting on said bent wire and acting on one of said base and the guide channel to retain said bent wire longitudinally of said pivot axis.

The problem is further solved by an adjustable switch for an elongated guide channel having a first longitudinal surface and first and second longitudinally extending shoulders on opposite sides thereof, said switch comprising, in combination, a base, first and second contacts at least one of which is mounted on said base for cooperation with the other, means mutually insulating said contacts, mounting surface means of said base adapted to overlie and engage the first longitudinal surface of the guide channel, first and second legs acting on said base and depending on opposite sides of said mounting surface means, inturned feet on each of said legs adapted to engage the shoulders on the guide channel to retain the switch base on the guide channel, one of said base, legs, and feet being resilient, and said inturned feet being spaced from said mounting surface means a distance sufficiently small to slightly deform said resilient part upon said feet being engaged with the shoulders of the guide channel and to establish sliding frictional engagement between said switch base and the guide channel for adjustable positioning of said switch base therealong.

The problem is further solved by a switch for actuation by a powered carriage movable along a guide channel, said switch comprising, in combination, a base, means for attaching said base to the guide channel, a contact part of said switch, a bent wire having actuating and pivot portions, a journal on said base journaling said pivot portion, actuator means connected to said pivot portion to be actuated by traverse of the carriage along the guide channel, said actuating portion adapted to be moved with actuated movement of said actuator means toward actuation of said switch relative to said contact part, and retention means to retain said bent wire longitudinally of the pivot axis and acting on one of said base and the guide channel in a plane lying outside of a plane through said base to permit ready assembly of said bent wire and said base.

An object of the present invention is to provide a limit switch which is of an economical construction yet is reliable in operation.

Another object of the present invention is to provide a limit switch which is simple and reliable and which provides for overtravel between the actuator and the switch contacts.

A further object of the present invention is to provide a switch wherein a bent or formed wire has a multiplicity of functions.

Another object of the invention is to provide a limit switch which may be longitudinally adjustable yet the resilience of a part of the switch in its attachment provides friction to hold the switch in place.

A still further object of the invention is to provide a switch having retention means retaining the bent wire pivot portion longitudinally in place, and which retention means is easily attained without interference with assembly of the switch.

Other objects and a fuller understanding of the invention may be had by referring to the following description and claims, taken in conjunction with the accompanying drawing.

DESCRIPTION OF THE PREFERRED EMBODIMENTS

Figure 1:
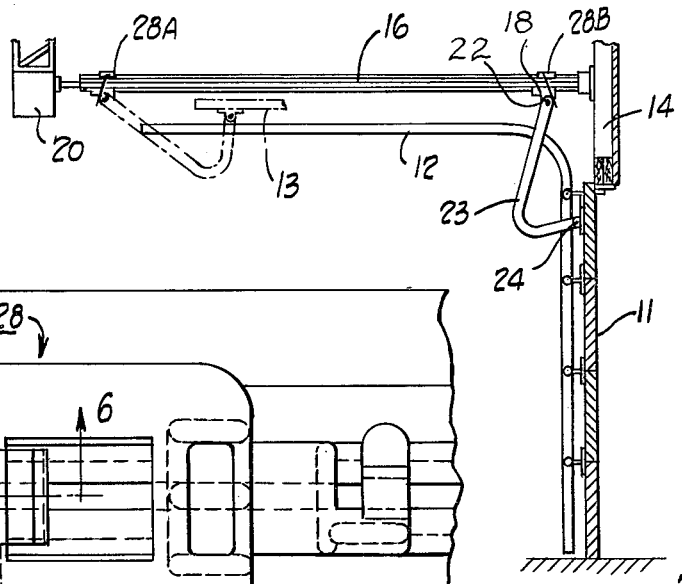
FIG. 1 is a side elevational view, partly in section, of a motor-operated garage door showing one environment of two switches of the present invention.
Figure 2:
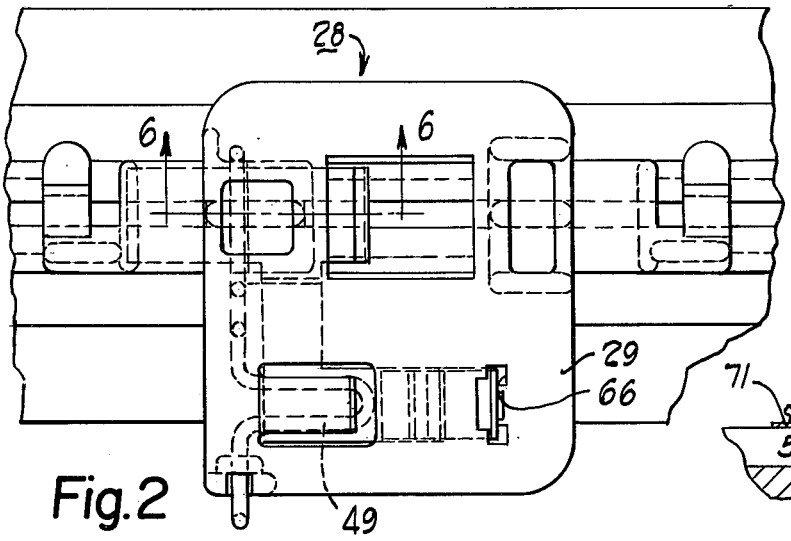
FIG. 2 is an enlarged plan view of a switch of the present invention in an unactuated condition.
Figure 6:
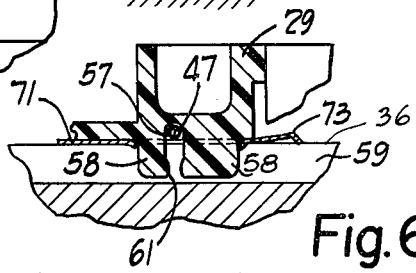
FIG. 6 is a sectional view on line 6—6 of FIG. 2.
Figure 5:
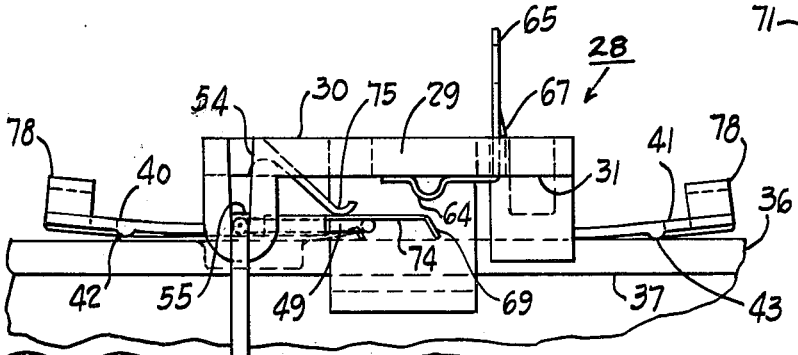
FIG. 5 is an enlarged plan view of a contact member as removed from the switch.
Figure 5:
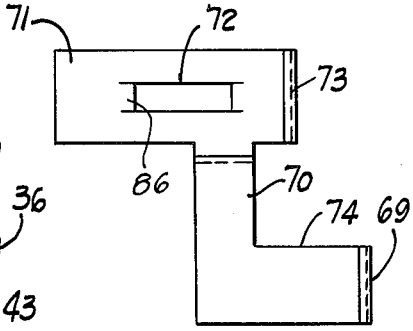

The switch of the present invention may be used in many ways; however, in order to illustrate a preferred embodiment, it has been illustrated in use with a motor-operated garage door. In this connection, FIG. 1 shows a garage door 11 which is adapted to move on a track 12 between an upper position 13, wherein it is generally parallel with the ceiling of the enclosure which it closes, and a down position in which it is shown in the full-line position of FIG. 1. A guide channel 16 is secured in the enclosure or garage 14 near the ceiling and comprises a horizontal guideway 17 within which a carriage 18 is adapted to move back and forth. The channel 16 serves to house a worm 19 which is rotatively driven by an electric motor and appropriate gear reduction mechanism contained in a housing 20. Driving connection is made between the worm 19 and the carriage 18 by means of a partial nut 21 which meshes with the worm 19 and, at an opposite portion (not shown), is connected to the carriage 18. The carriage is pivoted at 22 to one end of a drive link 23, the other end of which is pivoted at 24 to the garage door 11. As a result of this construction, the door 11 moves between its up and down positions as the carriage 18 travels back and forth in the guideway 17.

Two of the limit switches 28 of the present invention have been illustrated in FIG. 1 and have been identified respectively by the reference numerals 28A and 28B. As mentioned, these two limit switches are adapted to control the up and down limit of movement of the door 11 and, in that sense, control the electrical circuit means which supplies power to the motor contained in the housing 20. The electrical circuit means will not be further described in this application; however, the function performed by the switches 28A and 28B may be the same as that performed by switches 75 and 76, respectively, in U.S. Pat. No. 2,992,378, issued July 11, 1961. In this sense, switch 28A may be described as a normally open momentary contact up travel limit switch, and switch 28B as a normally open momentary contact down travel limit switch.

Since the details of construction of switches 28A and 28B are identical, only the specific structure of switch 28 as shown in FIGS. 2–6 will be described hereinafter. This switch 28 comprises a base 29 of insulating material. This base has an upper surface 30 and a lower surface 31. The base 29 has means for attaching the switch to the guide channel 16, and this attaching means 32 includes legs 33 and 34. The guide channel 16 has a first longitudinal surface 36, and first and second reentrant longitudinally extending shoulders 37 and 38, respectively. The legs 33 and 34 have inturned feet 39, and these feet engage the longitudinal shoulders 37 and 38 to cause the base 29 to be attached to the guide channel 16. The base 29 has mounting surface means which includes arms 40 and 41 extending longitudinally from the lower portion of the base 29. Support areas 42 and 43 are formed as transverse ridges on the lower portion of the arms 40 and 41, respectively, and these support areas 42 and 43 form the mounting surface means which engages the first longitudinal surface 36 on the upper surface of the guide channel 16. One of the base 29, legs 33 and 34, and inturned feet 39 are resilient in order to resiliently attach the switch 28 to the guide channel 16. In this preferred embodiment, the base 29 is unitary and is made from a resilient insulating material so that all three of these parts are somewhat resilient. The distance between the inturned feet 39 and the support plane established by the support areas 42 and 43 is slightly less than the distance between the first longitudinal surface 36 and the shoulders 37 and 38. This means that the one or more resilient parts are slightly stressed to resiliently and frictionally hold the base 29 on the guide channel 16. As best viewed in FIG. 3, this stressing primarily bends the arms 40 and 41 slightly upwardly generally at the connection thereof to the base 29, so that these arms 40 and 41 plus the base 29 are bowed slightly downwardly in the center towards the guide channel 16. This resilient attaching permits the entire switch 28 to be slid longitudinally along the guide channel 16, yet to be frictionally held in the desired adjusted position.

Another part of the switch 28 is a bent or formed wire 47. This bent wire is preferably of spring temper stainless steel and has unitary actuator, actuating, and pivot portions 48, 49, and 50, respectively. The actuator portion is adapted to be actuated by a stiff spring 52 mounted in the carriage 18. To this end, the actuator portion 48 is adapted to hang downwardly by gravity from the pivot portion 50. This pivot portion is freely pivotable in journal means carried by the base 29 above the level of the guide channel 16. This journal means includes a first journal 53 which is formed at the bottom of a vertical slot 54 at one edge of the base 29. A shoulder 55 is provided on the undersurface 31 of the base 29 to form an upper portion of this first journal 53. A second journal 56 is part of this journal means and is formed by a slot 57 between two studs 58, which extend downwardly into a longitudinal groove 59 in the top of the guide channel 16. This groove is for the purpose of receiving the flexible wire 60 (see FIG. 7) which is the external connection to the switch 28. Optional projections 61 may be provided on the inner surfaces of the studs 58 in order to frictionally hold the bent wire 47 in place in the slot 57 during assembly of the wire 47 to the base 29, prior to attachment to the guide channel 16.

A contact part 64 is provided in the switch 28. This contact part is unitary with a terminal 65 and the two form an L-shape passing through a slot 66 in the base 29, with a tongue 67 of the terminal 65 retaining this terminal in the base. This contact part 64 is curved to have a wiping action relative to a contact portion 69 of a contact member 70. This contact member 70 is better shown by itself in FIG. 5 and has a plate portion 71 overlying the first longitudinal surface 36 of the guide channel 16. An elongated aperture 72 surrounds the two studs 58 on the base 29 and permits the studs to pass downwardly through the plate portion 71 into the longitudinal groove 59. A downturned lip 73 is formed on the inner end of the plate portion 71 and is forced downwardly into good mechanical and electrical contact with the top of the guide channel 16 by the longitudinal downward bowing of the switch base upon its being attached to the guide channel 16. This contact member 70 may be formed of some resilient electrical conducting material, such as phosphor bronze, and may be relatively thin, such as 0.006 or 0.008 inch thick, so that the contact portion 69 is on the end of a resilient arm 74. Under such resilient arm is the actuating portion 49 of the bent wire 47. As the actuator portion 48 of the bent wire 47 is moved counterclockwise, as viewed in FIG. 3, the actuating portion 49 moves upwardly to move the contact portion 69 into wiping engagement with the contact part 64 to effect a switch-closed condition. A resilient tongue 75 is unitary with the base 29 and acts downwardly on the top of the resilient arm 74 as a deflectable limit stop for movement of the contact portion 69. Resilient feet 78 are unitary with the arms 40 and 41, and are used to hold in place the flexible wire 60, to help retain it in the longitudinal groove 59 except directly at the switch 28.

Figure 3:
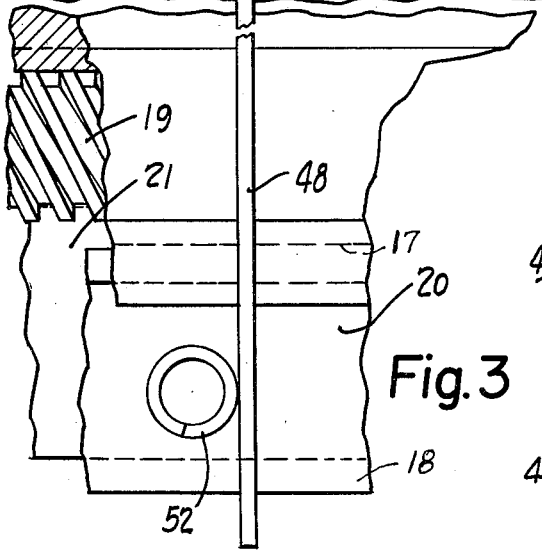
FIG. 3 is an enlarged side elevational view of the switch of FIG. 2.
Figure 4:
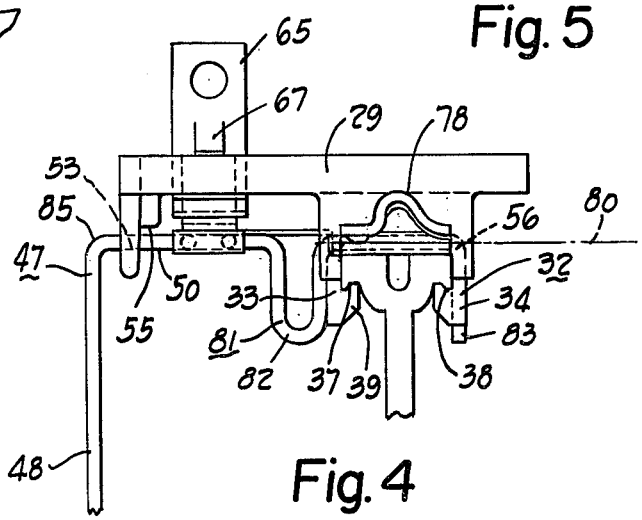
FIG. 4 is an enlarged end elevational view of the switch of FIG. 2.

Retention means 81 is provided to retain the bent wire 47 longitudinally of the pivot axis 80. This retention means lies outside of the plane of the base 29 to facilitate ready assembly of the bent wire and the base 29. As shown in FIGS. 3 and 4, this retention means 81 lies below the plane of the lower surface 31 of the base 29. The retention means acts on the bent wire 47, and also acts on one of the base 29 and the guide channel 16. In the preferred embodiments, the retention means 81 acts on the guide channel 16. The retention means 81 is provided by a U-shaped loop 82 as a unitary part of the bent wire 47 and also a downturned outer end 83 of this bent wire 47. The U-shaped loop is on one side of the guide channel 16 and the downturned outer end 83 is on the other side of this channel. Together, these two parts keep the bent wire 47 retained relative to the longitudinal direction of the pivot axis 80.

OPERATION

The switch 28 permits economical manufacture of the parts, as well as economical assembly of those parts. There are only four parts to the switch 28, as contrasted with the 13 parts of the switch shown in U.S. Pat. No. 3,439,134. These four parts are the base 29, the terminal 65, the bent wire 47, and the contact member 70.

A first subassembly in the assembly of the complete switch is the bent wire 47 assembled to the base 29. This subassembly may be achieved by threading the actuator portion 48 through the aperture of the first journal 53 until the corner 85 of the bent wire 47 has passed through this journal aperture 53. Then, the pivot axis portion of the bent wire 47 may be snapped into the second journal 56 through the projections 61 into the slot 57. These projections 61, if provided, aid in retaining the wire in this second journal slot 57. Next, the contact part 64 and terminal 65 may be assembled to the base 29 by simply pushing the terminal 65 through the slot 66 from the underside of the base 29. The tongue 67 will snap into place on the upper surface 30 of the base 29 to hold this terminal 65 and contact part 64 in place. Alternatively, the terminal 65 may be assembled to the base 29 prior to the assembling of the bent wire 47 onto the base 29.

Next, the contact member 70 is assembled onto the underside of the base 29 and the aperture 72 may be closely received on the studs 58 so as to provide a slight frictional engagement between the studs and the contact member 70. This is aided by lanced tongues 86 at the ends of the aperture 72. This helps to retain the contact member 70 temporarily in place to complete the assembly of the switch 28.

The switch 28 may now be assembled to the guide channel 16. The upper limit switch 28A is assembled on one side of the guide channel 16 and the down limit switch 28B is assembled on the opposite side of the guide channel 16. This is so that the actuator portion 48 hangs downwardly on opposite sides of the guide channel, and so that each of these two limit switches may be identical for economy of manufacture of the entire garage door operator. The stiff spring 52 is double-ended to actuate the switch regardless of on which side of guide channel 16 it is mounted. The switch 28 may be assembled onto the guide channel 16 simply by placing it over the top of the guide channel and pushing downwardly. The legs 33 and 34 are resilient, as are the arms 40 and 41; hence, as this base is pushed downwardly to engage the surface 36 on the top of the guide channel 16, these resilient parts may deflect so that the inturned feet 39 may engage the reentrant shoulders 37 and 38. This resilient snap-on connection of the base 29 onto the guide channel 16 is maintained until one of the legs 33 or 34 is pried outwardly so that the switch 28 may be removed from the guide channel 16.

When the base 29 is snapped onto the guide channel 16, this resilient deformation, primarily of the arms 40 and 41, causes the downturned lip 73 of the contact member 70 to dig into the top of the guide channel 16 for good electrical connection thereto. When the switch 28 is slid along the channel 16 to a new adjusted position, the lip 73 scrapes the channel to assure a good electrical grounding connection in the new position. When the carriage 18 traverses the guide channel 16 by means of the motor within the housing 20, the stiff spring 52 will move to the right, as viewed in FIG. 3, to engage the actuator portion 48. This moves this bent wire 47 in a counterclockwise direction, as viewed in FIG. 3. The U-shaped actuating portion 49, which underlies the resilient arm 74, is thus also moved in a counterclockwise direction. This moves the resilient arm 74 upwardly until the contact portion 69 engages the contact part 64 for a switch-closed condition. The switch 28, as illustrated in the preferred embodiment, is one which is a grounding type switch, grounding the terminal 65 to the guide channel 16 upon the switch-closed condition. Overtravel of the stiff spring is permitted by the spring temper of the wire 47, with all parts thereof being stressed and elastically deflecting.

Should the garage door coast too far upon motor deenergization, the stiff spring 52 may pass underneath the lower end of the actuator portion 48. In this case, the bent wire 47 could snap back clockwise. The downturned outer end 83 of the bent wire is adapted to engage the base 29, should this occur, to limit the amount of such clockwise movement of the bent wire so that it will not have its movement arrested with the actuator portion 48 in a vertically upward position; instead, this actuator portion will always hang downwardly. The first and second journals 53 and 56 are a slightly loose fit so that the bent wire has free pivotal movement to return to hanging vertically downwardly, and so that the switch does not remain in an actuated condition after removal of the stiff spring 52. As mentioned above, it is possible that the stiff spring 52 could coast to pass beyond the lower end of the actuator portion 48, causing it to spring in a counterclockwise direction. It then would rebound from the base, and would again swing counterclockwise. The resilient tongue 75 as a part of the base 29 will give added resistance to the upward movement of the resilient arm 74 so that it will not again contact the contact part 64. This prevents double actuation of the switch contacts for a single traverse of the carriage 18, which prevents a false signal being given to the door operaor electrical circuit.

Figure 7:
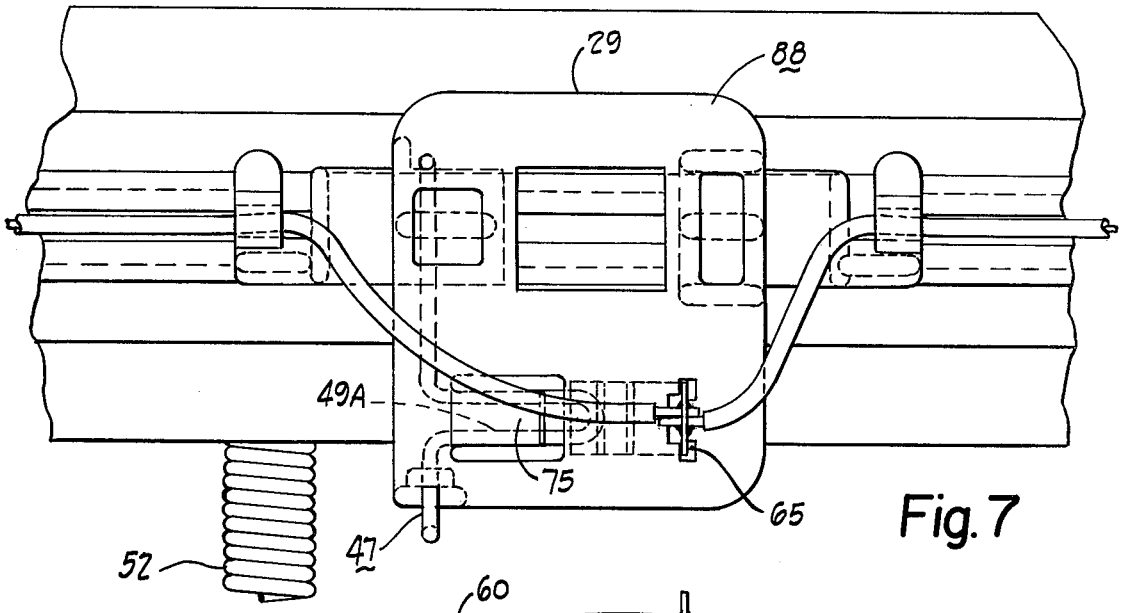
FIG. 7 is an enlarged plan view of a modified switch.
Figure 8:
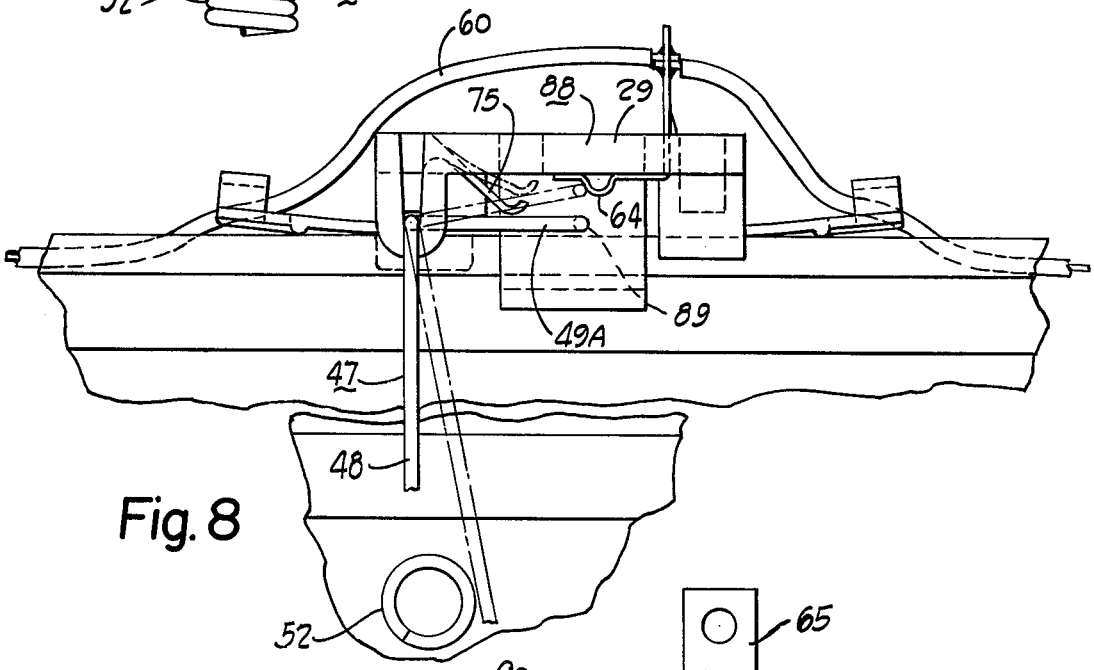
FIG. 8 is an enlarged side elevational view of the modified switch of FIG. 7.
Figure 9:
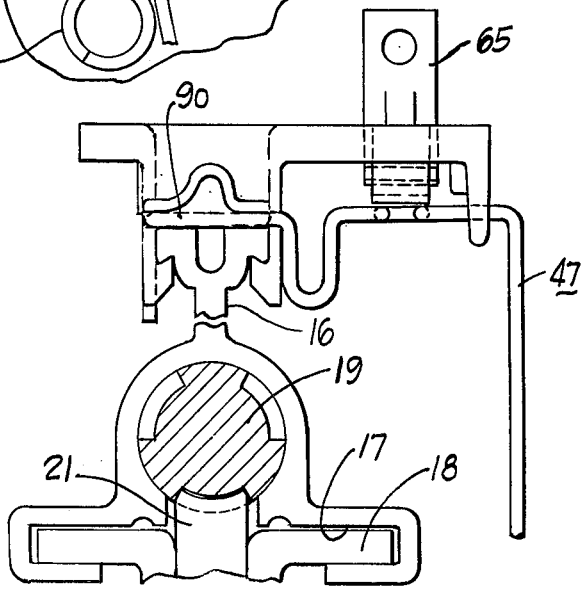
FIG. 9 is an enlarged end elevational view of the modified switch of FIG. 7.

FIGS. 7, 8, and 9 illustrate a second embodiment of a switch 88, which is quite similar to the switch 28 of FIGS. 1–6. Many of the parts are identical and have the same reference numerals as in the switch of FIGS. 1–6. A difference is that the contact member 70 is eliminated for an even more economical switch. The actuating portion of the bent wire 47 has reference numeral 49A, because it has been made slightly longer to have the bight 89 of the U-shaped loop of this actuating portion 49 actually act as the contact portion. This bight 89 engages the contact part 64 in a wiping action. The resilient arm 75, unitary with the base 29, now engages this U-shaped actuating portion 49A to again prevent contact bounce, which could give an undesirable double actuation of this switch 88.

OPERATION

The assembly of the switch 88 is even simpler than the assembly of the switch 28, because it has only three parts rather than four. The assembly is the same as that for switch 28, except that the absence of the contact member 70 means that such contact member is not assembled into the switch 88. The switch 88 is also assembled onto the guide channel 16 in the same way; namely, it may be snapped downwardly over the top of this guide channel until the inturned feet 39 engage the longitudinal shoulders 37 and 38. The resilience of the arms 40 and 41 will readily accommodate the absence of the contact member 70 and still resiliently attach the switch 88 to the guide channel 16, despite the absence of this thin contact member 70. Also, the switch 88 may be longitudinally adjusted along the length of the guide channel 16 in the same way to position the limit switch in a desired position for satisfactory operation of the garage door operator.

When the carriage 18 moves to the right, the stiff spring 52 also moves to the right, as viewed in FIG. 8, to actuate the bent wire 47 in a counterclockwise direction. This raises the U-shaped actuating portion 49 until the contact portion 89 engages the contact part 64 in a wiping action. Again, this motion is resisted by the resilient tongue 75, which prevents contact bounce or double contact actuation should the stiff spring 52 move past the lower end of the actuator portion 48. As the actuator portion 48 is moved counterclockwise, and as the contact portion 89 comes into engagement with the contact part 64, there is a downward component of force on the pivot portion 90 of the bent wire, as shown in FIG. 9, to cause it to more firmly engage the top surface 36 of the guide channel 16. Also, this bent wire 47 has a slight rotating action relative to this top surface 36 to give a wiping contact action relative to the guide channel 16. This helps to keep this pivot portion 90 and guide channel 16 clean at this contact position, which becomes an electrical contact to ground the wire 47 to the guide channel 16. Such channel may be of extruded aluminum, for example, and is a part of the grounded circuit of the garage door operator.

It will be noted from FIGS. 7–9 that the contact portion 89 is unitary with the bent wire 47, whereas, in FIGS. 1–6 the contact portion 69 is separate from the bent wire and merely actuated by movement of such bent wire. One of the contact part 64 and contact portion 69 is on the base 29, and in the preferred embodiments this is the contact part 64, with the two mutually insulated by the insulation material of the base 29.

The base 29 has been shown as being of insulating material, and this base may be made in a simple two-part mold, yet forming all of the aforementioned parts, including the journal portions, the legs 33 and 34 with the inturned feet, and the resilient tongue 75. This aids the low cost production of this part. The base, as a unitary piece, may be from a suitable resilient insulating material, e.g., an amide or acetyl resin, such as a nylon or Delrin, a trademark of DuPont de Nemours & Co., Inc., and, as such, provides the means for relatively insulating the two contacts 64 and 69 in FIGS. 1–6, or 64 and 89 in FIGS. 7–9. This one-piece base 29 provides two parts longitudinally spaced apart and two other parts near the midpoint, so that when the switch is snapped onto the guide channel 16, this base is resiliently deformed to establish sliding frictional engagement between the switch base and the guide channel for adjustable positioning of the switch base therealong. In the preferred embodiment, the two parts which are longitudinally spaced are the support areas 42 and 43 and the two parts which are near the midpoint are the two depending legs 33 and 34. This provides the longitudinal bowing of the one-piece base.

The retention means 81 is that which retains the bent wire longitudinally of the pivot axis 80. This assures that the actuator portion 48 will hang in the proper position for actuation by the stiff spring 52 and also assures that the actuating portion 49 will act properly on the resilient arm 74 of the contact member 70. This retention means 81 lies outside of the plane of the base 29, at least outside of the space between the upper and lower surfaces 30 and 31 thereof. By such construction, the assembly of the bent wire onto the base 29 is greatly facilitated, as described above, and no rivets, screws, or other securing means are required in order to hold together these two parts in the subassembly. The fact that the retention means 81 acts on the guide channel which lies outside the plane of the base 29, is a primary reason why the switch 28 or 88 is simple and economical to assemble.

The present disclosure includes that contained in the appended claims, as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and the scope of the invention as hereinafter claimed.

What is claimed is:

1. A switch for actuation by a powered carriage movable along a guide channel, said switch comprising, in combination:

a base;

means for attaching said base to the guide channel;

a contact part and a cooperable contact portion at least one of which is mounted on said base and the other of which is adapted to be supported on either the base or the guide channel;

means relatively insulating said contact part and said contact portion;

a bent wire having actuator, actuating, and pivot portions;

a journal on said base journaling said pivot portion on a pivot axis;

said actuator portion adapted to be actuated by traverse of the carriage along the guide channel;

said actuating portion being connected to said actuator portion to be moved with actuated movement of said actuator portion to relatively actuate said contact part and said contact portion between switch-open and switch-closed conditions; and retention means acting on said bent wire and acting on one of said base and the guide channel to retain said bent wire longitudinally of said pivot axis.

2. A switch as set forth in claim 1, wherein said base is formed of insulation material as part of said insulating means.

3. A switch as set forth in claim 1, wherein said contact part is integral with a terminal of said switch for external connection thereto.

4. A switch as set forth in claim 1, wherein said retention means includes a retention portion unitary with said bent wire.

5. A switch as set forth in claim 4, wherein said retention means includes portions of said bent wire acting on opposite sides of the channel.

6. A switch as set forth in claim 1, wherein said attaching means includes legs integral with said base adapted to engage longitudinal shoulders on the guide channel.

7. A switch as set forth in claim 6, wherein said shoulders are reentrant shoulders to make said attaching means more positive.

8. A switch as set forth in claim 6, wherein said legs are resilient.

9. A switch as set forth in claim 1, wherein said contact portion is unitary with said bent wire.

10. A switch as set forth in claim 1, wherein said contact portion is separate from said bent wire and is adapted to be moved by said actuating portion.

11. An adjustable switch for an elongated guide channel having a first longitudinal surface and first and second longitudinally extending shoulders on opposite sides thereof, said switch comprising, in combination:

a base;

first and second contacts at least one of which is mounted on said base for cooperation with the other;

means mutually insulating said contacts;

mounting surface means of said base adapted to overlie and engage the first longitudinal surface of the guide channel;

first and second legs acting on said base and depending on opposite sides of said mounting surface means;

inturned feet on each of said legs adapted to engage the shoulders on the guide channel to retain the switch base on the guide channel;

one of said base, legs, and feet being resilient; and said inturned feet being spaced from said mounting surface means a distance sufficiently small to slightly deform said resilient part upon said feet being engaged with the shoulders of the guide channel and to establish sliding frictional engagement between said switch base and the guide channel for adjustable longitudinal positioning of said switch base therealong.

12. A switch as set forth in claim 11, wherein said base is of insulating material as part of said insulating means.

13. A switch as set forth in claim 11, wherein one of said legs and said mounting surface means is longitudinally outboard of the other thereof to resiliently deform said base with a longitudinal bow.

14. A switch as set forth in claim 11, wherein said legs are at an intermediate area of said base, and said mounting surface means including support areas longitudinally outboard of said legs to resiliently deform said base toward the first longitudinal surface in between said support areas.

15. A switch as set forth in claim 11, wherein said legs are integral with said base.

16. A switch as set forth in claim 11, wherein said legs and feet are unitary with said base.

17. A switch as set forth in claim 11, including a thin resilient blade having a part thereof acting as said second contact, and said blade being disposed and trapped between said base and the first longitudinal surface of the guide channel.

18. A switch for actuation by a powered carriage movable along a guide channel, said switch comprising, in combination:

a base;

means for attaching said base to the guide channel;

a contact part of said switch;

a bent wire having actuating and pivot portions;

a journal on said base journaling said pivot portion;

actuator means connected to said pivot portion to be actuated by traverse of the carriage along the guide channel;

said actuating portion adapted to be moved with actuated movement of said actuator means toward actuation of said switch relative to said contact part; and retention means to retain said bent wire longitudinally of the pivot axis and acting on one of said base and the guide channel in a plane lying outside of a plane through said base to permit ready assembly of said bent wire and said base.

19. A switch as set forth in claim 18, wherein said retention means lies in a plane on the guide channel side of said base.

20. A switch as set forth in claim 18, wherein said retention means acts on said guide channel to aid ready assembly of said wire on said base prior to attaching said base to the guide channel.

21. A switch as set forth in claim 18, wherein said retention means is a unitary part of said bent wire.

22. A switch as set forth in claim 18, wherein said retention means includes first and second portions acting in opposite directions longitudinally of the pivot axis.

23. A switch as set forth in claim 22, wherein said first portion acts on one side of said guide channel and said second portion acts on the opposite side of said guide channel.

* * * * *